United States Patent [19]

Yost

[11] 4,179,058

[45] Dec. 18, 1979

[54] SOFFIT NAIL SET

[76] Inventor: Neal E. Yost, 415 Nescopec St., Tamaqua, Pa. 18252

[21] Appl. No.: 915,785

[22] Filed: Jun. 15, 1978

[51] Int. Cl.[2] ..... B25C 9/00

[52] U.S. Cl. ..... 227/147

[58] Field of Search ..... 227/147, 140, 156

[56] References Cited

U.S. PATENT DOCUMENTS

| | | | |
|---|---|---|---|
| 327,537 | 10/1885 | Dodsworth | 227/147 X |
| 373,265 | 11/1887 | Bloodworth | 227/147 X |
| 1,575,582 | 3/1926 | Joy | 227/147 |
| 1,776,646 | 9/1930 | Wilson | 227/147 |
| 2,430,532 | 11/1947 | Rayburn | 227/147 X |
| 3,012,247 | 12/1961 | Sillars et al. | 227/147 X |

*Primary Examiner*—Paul A. Bell

*Attorney, Agent, or Firm*—Herbert L. Gatewood

[57] ABSTRACT

Nail set comprising in combination a punch holder and a punch or driver for use as an overhead device in driving nails into a workpiece, in particular an aluminum soffit such as encountered in providing aluminum siding on a house or other building. The nail set provides accurate setting of a nail into the soffit and underlying substructure, and eliminates damage to, and marring of, the aluminum soffit.

7 Claims, 3 Drawing Figures

SOFFIT NAIL SET

BACKGROUND OF THE INVENTION

1. Field of Invention

This invention relates to a nail set, in particular a soffit nail set, for use as an overhead device in driving nails into the soffit or other work piece, and to its particular manner of construction.

2. Description of the Prior Art

When driving nails into wood or other substrates, one must be extremely careful not to drive the nail too deep into the substrate, else the substrate may be marred by the hammerhead, or other driving tool. However, the nail should not protrude outwardly from the work piece and should be driven into the workpiece or substrate the entire length of the shank of, e.g., a headed nail.

Over the years, various nail drivers and sets have been developed to provide better and more accurate setting of a nail without attendant marring of the work piece. Nail sets, in general, compromise a punch holder in combination with a punch. One end of the punch is hit a blow by a hammer or the like and the other end in contact with a nail transmits the blow to the nail, driving it into the work piece. These devices ordinarily work best with a predetermined maximum length of nail, and when used with such a nail do not allow penetration of the nail into the work piece below a certain depth. The devices are sometimes provided with means to prevent a punch from falling out of the holder, particularly if the nail set device is used in inverted position on overhead work.

In U.S. Pat. No. 924,054 there is provided a nail setter comprising a punch holder and punch in which the punch holder is provided with caps on each end thereof so as to limit forward and rearward movement of the punch or plunger. When using the device for overhead work, the plunger is first pushed upward to its forward limit and is there set by a thumbpiece provided on the device to prevent the plunger dropping back by gravity.

There is shown in U.S. Pat. No. 1,575,582, a nail driver and set in which forward movement of the plunger is limited by the upper end of the plunger, i.e., the blow receiving head, which is of somewhat greater diameter than the bore of the punch holder. To prevent the driving pin or plunger from becoming disengaged from the punch holder, as disclosed in the patent, a key is optionally provided on the holder which extends therefrom into a longitudinal groove or key-way on the punch.

The driving head of the plunger in U.S. Pat. No. 1,776,646, as in U.S. Pat. No. 1,575,582, is of greater diameter than the bore of the holder thereby limiting the driving movement of the plunger relative to the barrel of the holder. To prevent disengagement of the plunger from the barrel, as by gravity, a split ring is provided in combination with the plunger which engages with the bore of the holder.

In U.S. Pat. No. 2,725,558, forward movement of the plunger or driver is limited by a shoulder on the punch holder. Nails are held in position by springs located in the end of the punch holder so as to prevent their being driven into the work piece at an undesired angle.

While the various nail sets that I am aware of provide satisfactory performance in certain situations, I am not aware of any that have been found satisfactory in driving nails into the aluminum soffit on providing this siding material on houses. This results not only from the fact that the soffit offers too narrow a space for satisfactory seating of the punch holder, but also because the nail holder is constructed of metal. Thus, contact between the metal nail set and the aluminum soffit, often results in marring and scratching of the aluminum surface. The use of a hammer without using a nail set is also unsatisfactory because of the size of the hammerhead, as well as this material of construction.

SUMMARY OF THE INVENTION

There is provided in accordance with my invention a nail set comprising in combination a punch holder and a punch of novel and unique construction not attendant with the problems set forth above, particularly suited for the driving of nails into a work piece, in particular an aluminum soffit or certain predetermined configuration.

In its more basic aspects, the nail set of the invention comprises in combination a punch holder and a punch in which the punch holder comprises an elongated main body portion and an end portion integral with said main body portion for association with the work piece, the punch holder further comprising a main circular bore, and a smaller circular bore concentric therewith of a predetermined diameter to accommodate a nail head, the two said circular bores being in longitudinal alignment and communicating with one another, a first annular seat separating the main bore from the smaller bore, and an elongated slot of predetermined length in said main body portion extending longitudinally and opening inwardly into said main bore, and said punch comprising an elongated cylindrically shaped blow receiving body portion and a smaller diameter cylindrically shaped concentric driving portion in longitudinal alignment and integral therewith, a second annular seat separating said blow receiving body portion from said driving portion whereby forward movement of the punch is limited by said first annular seat, the diameters of the circular bores being such as to accommodate the respective diameters of the punch, and means extending outwardly from said blow receiving body portion and in association with said elongated slot whereby said holder and punch are maintained in combination with one another.

The more preferred embodiment of the invention comprises a punch holder end portion that conforms with the configuration of the particular work piece configuration into which is to be driven a nail. The preferred work piece is an aluminum soffit having a U-shaped configuration comprising a bottom planar portion and outwardly sloping sides extending downwardly therefrom, in which case the punch holder end portion comprises a first pair of planar sides which taper inwardly toward one another at equal angles whereby to conform to said U-shaped configuration, and a planar end surface for seating contact with the bottom planar portion of the aluminum soffit. Most preferably, the end portion of the punch holder is further provided with a plastic coating to prevent scratching and marring of the aluminum surface.

Quite advantageously, as the end portion of the nail set punch holder conforms to the work piece in which a nail is to be driven, the nail is seated into the work piece at the desired 90° angle. Moreover, as scratching and marring of the work piece is eliminated, use of a nail set in accordance with the invention provides a more satisfactory appearance in the finished work.

BRIEF DESCRIPTION OF THE DRAWING

The invention is described hereinafter in greater detail by reference to the drawing in which.

DETAILED DESCRIPTION OF THE INVENTION AND THE PREFERRED EMBODIMENTS

Figure 1:
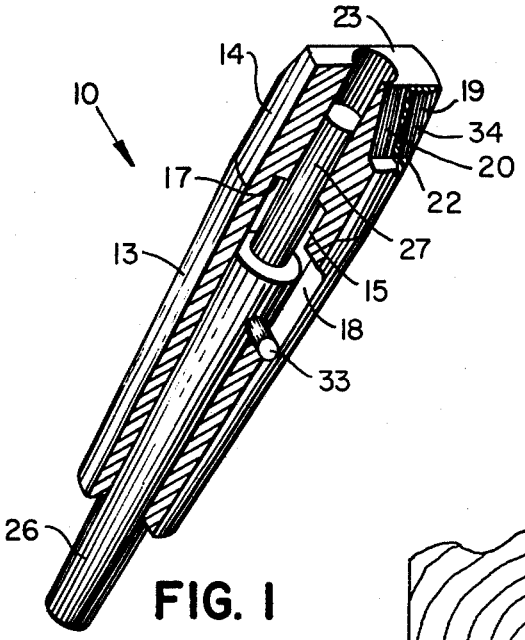
FIG. 1 is a view in perspective of a soffit nail set in accordance with the invention showing the punch holder in section.

Turning now to the drawing, there is disclosed therein in FIG. 1 a soffit nail set assembly 10 in accordance with the invention comprising a punch holder or barrel 11 and a punch or plunger 12. As indicated in the drawing, punch holder 11 comprises an elongated main body portion 13 and an end portion 14 integral with the main body portion. A main circular bore 15 is provided longitudinally down the center of punch holder 11. In alignment with main circular bore 15 is provided circular bore 16 of smaller diameter, the two bores communicating with one another as indicated in the drawing. An annular seat 17 separates main bore 15 from the smaller circular bore 16. The bores are concentric with one another, having their center located on the longitudinal center line of punch holder 11.

An elongated slot 18 of predetermined length is provided in main body portion 13 extending longitudinally and opening inwardly into main circular bore 15. The purpose of elongated slot 18 will be hereinafter explained, if not already obvious.

As indicated in the drawing, end portion 14 is of conical shape tapering inwardly from the interface between main body portion 13 and end portion 14. The end portion comprises two planar sides 19, 20 that taper inwardly toward one another from bearing surfaces 21, 22 to planar end surface 23. Bearing surfaces 21, 22 are in the same plane with one another and are perpendicular to the longitudinal center line of punch holder 13. Planar end surface 23 is parallel to bearing surfaces 21, 22 and to distal end surface 24. As indicated in the drawing, conical end portion 14 blends with main body portion 13 at reference numeral 25.

Figure 2:
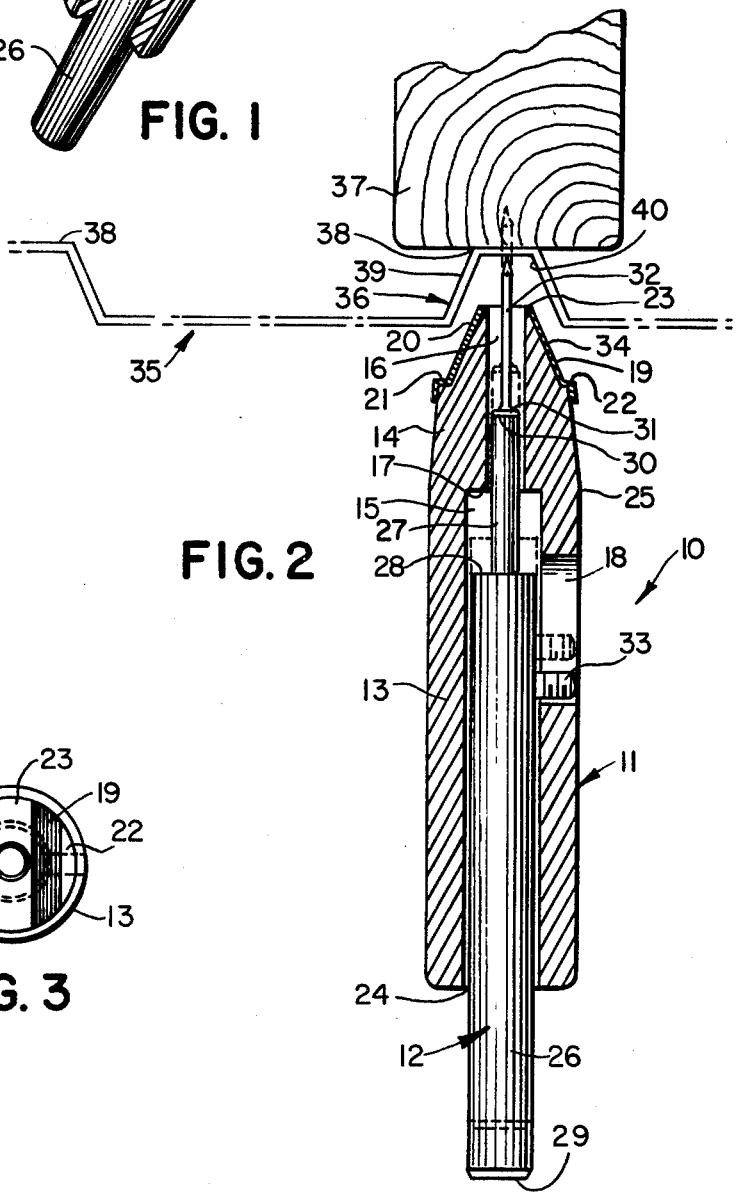
FIG. 2 is a sectional view of the soffit nail set shown in FIG. 1, showing the nail set in operation in driving a nail into an aluminum soffit.
Figure 3:
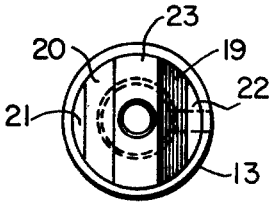
FIG. 3 is an end view of the nail set of the invention, taken from the operative end.

Punch 12 is, as indicated more clearly in FIG. 2 of the drawing, of circular shape and is conformably and slideably received in main circular bore 15 and smaller circular bore 16. Punch 12 comprises a cylindrically shaped blow receiving body portion 26 and a lesser diameter cylindrically shaped concentric driving portion 27, separated by annular seat 28. Blow receiving body portion 26 and driving portion 27 are integral with one another, and in longitudinal alignment. At the end of the blow receiving body portion 26 remote from driving portion 27 is provided planar surface 29 perpendicular to the center line of body portion 26 for receiving a blow by a hammer or other driving device. This blow is, of course, transmitted to driving portion 27 of punch 12 which terminates in planar drive face 30 parallel to planar surface 29, and in contact with the planar head 31 of nail 32.

Located in main body portion 26 somewhat remote from the blow receiving end 29 is means 33 extending outwardly from and perpendicular to main body portion 26. Means 33 is received in elongated slot 18 whereby punch 12 is prevented from accidental disengagement from punch holder 13. This is particularly advantageous when using nail set assembly 10 for driving nails in overhead substrates. However, it should be made clear that the length of elongated slot 18 is chosen so as not to control the forward movement of punch 12 when dealt a hammer blow.

As will be appreciated in referring to the drawing, more particularly FIG. 2, the forward or driving motion of punch 12 is, of course, limited by annular seat 17 in punch holder 11. Thus, the main bore 15 of punch holder 11 should be bored out to such a depth as will allow proper seating of the nail into the work piece. The length of small bore 16 and drive portion 27 of punch 12 will be the same, thereby providing drive face 30 to be in the same plane as end surface 23 at its forward extremity. This allows not only for proper seating of nail 32 but makes certain nail 32 is not driven below the work piece surface.

End portion 14, in particular support edges 21, 22; side faces 19, 20; and end surface 23 are desirably provided with protective coating 34. Thus, when using nail set assembly 10 in driving nails into an aluminum soffit, metal-to-metal contact is prevented and scratching of the aluminum surface is prevented. Various materials can be used for this purpose; however, one that will be found quite satisfactory is available commercially under the trade designation Plastic Peel Coating #7762 T23 Clear from McMaster Car Supply Co., Chicago, Ill. This can be applied to the desired surfaces by merely dipping punch holder 13 into the coating material. A protective coating thickness of about 1/32 inches will be found satisfactory. Repeated coatings can be applied, if desired, from time to time.

As shown in FIG. 2 of the drawing, the nail set assembly is quite advantageously used in driving nails 32 in aluminum soffit 35, at desired locations. Located intermittently along the soffit are U-shaped indentations 36 bearing against furring strips 37. These indentations comprise a planar bottom 38 and outwardly, and downwardly, sloping sides 39, 40 which terminate at the soffit surface. The end portion 14 of punch holder 12 conforms to the configuration of U-shaped indentation 36, as shown in the drawing, planar end surface 23 seating itself against planar bottom 38. As will be appreciated, sloping or tapered sides 19, 20 in combination with edge supports 21, 22 control the positioning of the punch holder 13.

In use as shown in FIG. 2, when end surface 29 is dealt a driving blow, the force is transmitted to drive surface 30 in contact with head 31 of nail 32, driving the nail through the aluminum soffit into the furring strip 37.

While the measurements of punch 12 and punch holder 13 can vary somewhat, depending on the particular use to which the nail set is put, the dimensions for use as a soffit nail set are determined by the dimensions and configuration of the soffit and the size nail to be used. The soffit indentations require that support edges 21, 22 be ½ inch distant from planar end surface 23, and that planar sides 19, 20 be tapered at 45° angles toward one another. Conical end portion 14 desirably peaks at a 12° angle. Small bore 16 is 1.187 inches long and desirably approximately ¼ inch in diameter. The length of punch drive body portion 27 is the same as that for the small bore; however, overall a punch body length of 5 inches will be found suitable.

The outer surface of main body portion 13 can be roughened, for example, by knurling, to provide a better hand grip on the punch holder.

As many different embodiments of this invention will now occur to those skilled in the art, it is to be understood that the specific embodiments of the invention as presented herein are intended by way of illustration only and are not limiting on the invention, but that the limitations thereon can be determined only from the appended claims.

What I claim is:

1. Nail set assembly for use as an overhead device in driving nails through the bottom planar portion of a U-shaped indentation in an aluminum soffit and into a supporting surface for the soffit, said U-shaped configuration characterized by a bottom planar portion and equally outwardly sloping planar sides extending downwardly therefrom and terminating at the soffit surface comprising in combination a punch holder and a punch, said punch holder comprising an elongated main body portion and an end portion integral with said main body portion for association with the said U-shaped indentation, said punch holder further comprising a main circular bore in said main body portion and a smaller circular bore communicating with said main bore and concentric therewith in said integral end portion and of a predetermined diameter to accommodate a nail head and an annular seat separating the main bore from the smaller bore, said punch holder end portion being of a conical shape tapering inwardly at a predetermined angle from the interface of the end portion with said main body portion toward the end of the end portion, said punch holder end portion having a pair of planar sides which taper inwardly toward one another at equal angles corresponding to the angles of the sloping planar sides of the U-shaped indentation and terminating at a planar elongated end surface lateral to the longitudinal centerline of the punch holder, support edges for the punch holder in said punch holder end portion and in the same lateral plane from which the said planar tapering sides depend for supporting the punch holder upright in the U-shaped indentation and the planar end surface of the punch holder against the bottom planar surface of the said U-shaped indentation whereby a nail will be driven into the soffit supporting surface at 90°, said support edges being in the same plane and parallel to the said elongated planar end surface, and said punch comprising an elongated cylindrically shaped blow receiving body portion and a smaller diameter cylindrically shaped concentric driving portion in longitudinal alignment and integral therewith, the blow receiving body portion being provided on its end with a planar surface perpendicular to the centerline of the body portion for receiving a blow by a driving device, a planar drive face on the end of the driving portion parallel to the planar blow receiving surface for contact with the nail to be driven, an annular seat separating said blow receiving body portion from said driving portion whereby forward movement of the punch is limited by said annular seat of the punch holder, the diameters of the circular bores being such as to accommodate the respective diameters of the punch and to allow freedom in longitudinal movement, the respective lengths of said driving portion of the punch and the smaller circular bore and the location of the shoulders on each being such that the planar drive face of the punch will be in the same plane as the planar end surface of the punch holder on the punch being at its forward extremity.

2. Nail set assembly for use as an overhead device in driving nails through the bottom planar portion of a U-shaped indentation in an aluminum soffit and into a supporting surface for the soffit, said U-shaped configuration characterized by a bottom planar portion and equally outwardly sloping planar sides extending downwardly therefrom and terminating at the soffit surface according to claim 1 wherein said planar sides of the punch holder taper inwardly toward one another at a 45° angle.

3. Nail set assembly for use as an overhead device in driving nails through the bottom planar portion of a U-shaped indentation in an aluminum soffit and into a supporting surface for the soffit, said U-shaped configuration characterized by a bottom planar portion and equally outwardly sloping planar sides extending downwardly therefrom and terminating at the soffit surface according to claim 1 wherein an elongated slot of predetermined length is provided in said main body portion extending longitudinally of the main body portion and opening inwardly into said main circular bore, and means extending outwardly from said blow receiving body portion and in association with said elongated slot whereby said holder and punch are maintained in combination with one another.

4. Nail set assembly for use as an overhead device in driving nails through the bottom planar portion of a U-shaped indentation in an aluminum soffit and into a supporting surface for the soffit, said U-shaped configuration characterized by a bottom planar portion and equally outwardly sloping planar sides extending downwardly therefrom and terminating at the soffit surface according to claim 3 wherein said outwardly extending means comprises a set screw.

5. Nail set assembly for use as an overhead device in driving nails through the bottom planar portion of a U-shaped indentation in an aluminum soffit and into a supporting surface for the soffit, said U-shaped configuration characterized by a bottom planar portion and equally outwardly sloping planar sides extending downwardly therefrom and terminating at the soffit surface according to claim 1 wherein said main body portion comprises a roughened surface whereby to provide a better hand grip on the punch holder.

6. Nail set assembly for use as an overhead device in driving nails through the bottom planar portion of a U-shaped indentation in an aluminum soffit and into a supporting surface for the soffit, said U-shaped configuration characterized by a bottom planar portion and equally outwardly sloping planar sides extending downwardly therefrom and terminating at the soffit surface according to claim 5 wherein said roughened surface comprises a knurled surface.

7. Nail set assembly for use as an overhead device in driving nails through the bottom planar portion of a U-shaped indentation in an aluminum soffit and into a supporting surface for the soffit, said 6-shaped configuration characterized by a bottom planar portion and equally outwardly sloping planar sides extending downwardly therefrom and terminating at the soffit surface according to claim 1 wherein said end portion further comprises a plastic coating on at least said support edges, said planar sides, and said planar end surface.

* * * * *